US008794314B2

(12) United States Patent
Stimpfle-Ziegler

(10) Patent No.: US 8,794,314 B2
(45) Date of Patent: Aug. 5, 2014

(54) DRILL ROD

(75) Inventor: Andreas Stimpfle-Ziegler, Kuehbach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 346 days.

(21) Appl. No.: 13/412,424

(22) Filed: Mar. 5, 2012

(65) Prior Publication Data

US 2012/0222858 A1 Sep. 6, 2012

(30) Foreign Application Priority Data

Mar. 4, 2011 (EP) ..... 11001832

(51) Int. Cl.
*E21B 17/00* (2006.01)

(52) U.S. Cl.
USPC ..... 166/242.6; 340/854.8; 175/320

(58) Field of Classification Search
CPC ... E21B 17/003; E21B 17/0028; E21B 47/12; E21B 47/122; F16L 15/08; F16L 25/01
USPC ..... 166/65.1, 242.6, 380; 340/853.1, 854.8, 340/854.9; 175/320; 367/82
See application file for complete search history.

(56) References Cited

U.S. PATENT DOCUMENTS

| | | | | |
|---|---|---|---|---|
| 4,220,381 | A | 9/1980 | van der Graaf | |
| 4,557,538 | A | 12/1985 | Chevalier | |
| 4,722,402 | A * | 2/1988 | Weldon | 175/104 |
| 5,240,082 | A | 8/1993 | Hayabuchi et al. | |
| 6,641,434 | B2 * | 11/2003 | Boyle et al. | 439/577 |
| 6,866,306 | B2 * | 3/2005 | Boyle et al. | 285/333 |
| 6,981,546 | B2 * | 1/2006 | Hall et al. | 166/65.1 |
| 7,098,767 | B2 * | 8/2006 | Hall et al. | 336/234 |
| 7,114,970 | B2 * | 10/2006 | Head | 439/191 |
| 7,224,288 | B2 * | 5/2007 | Hall et al. | 340/853.7 |
| 7,413,021 | B2 * | 8/2008 | Madhavan et al. | 166/380 |
| 7,683,802 | B2 * | 3/2010 | Madhavan et al. | 340/854.8 |

(Continued)

FOREIGN PATENT DOCUMENTS

| | | | |
|---|---|---|---|
| EP | 1077307 | A1 | 2/2001 |
| GB | 2375779 | A | 11/2002 |
| JP | S54-134001 | A | 10/1979 |
| JP | S59-31395 | A | 2/1984 |

(Continued)

OTHER PUBLICATIONS

European Search Report; EP11001832; Jul. 7, 2011.

(Continued)

*Primary Examiner* — Daniel P Stephenson
(74) *Attorney, Agent, or Firm* — Studebaker & Brackett PC

(57) ABSTRACT

The invention relates to a drill rod having at least two rod elements, which are connected to each other in a rotationally fixed and detachable manner, wherein the rod elements each have an inner pipe and an outer pipe, between which a ring-shaped receiving space is formed, the rod elements each have an energy and/or data line, which extends along a longitudinal axis of the drill rod, and the energy and/or data lines of the rod elements are each connected to an induction coil, wherein the induction coils can be coupled to each other inductively for energy and/or data transmission along the drill rod. A first rod element has an inner induction coil located at an outer circumference of its inner pipe and a second rod element has an outer induction coil located at an inner circumference of its outer pipe.

11 Claims, 10 Drawing Sheets

(56) References Cited

U.S. PATENT DOCUMENTS

Figure 1:
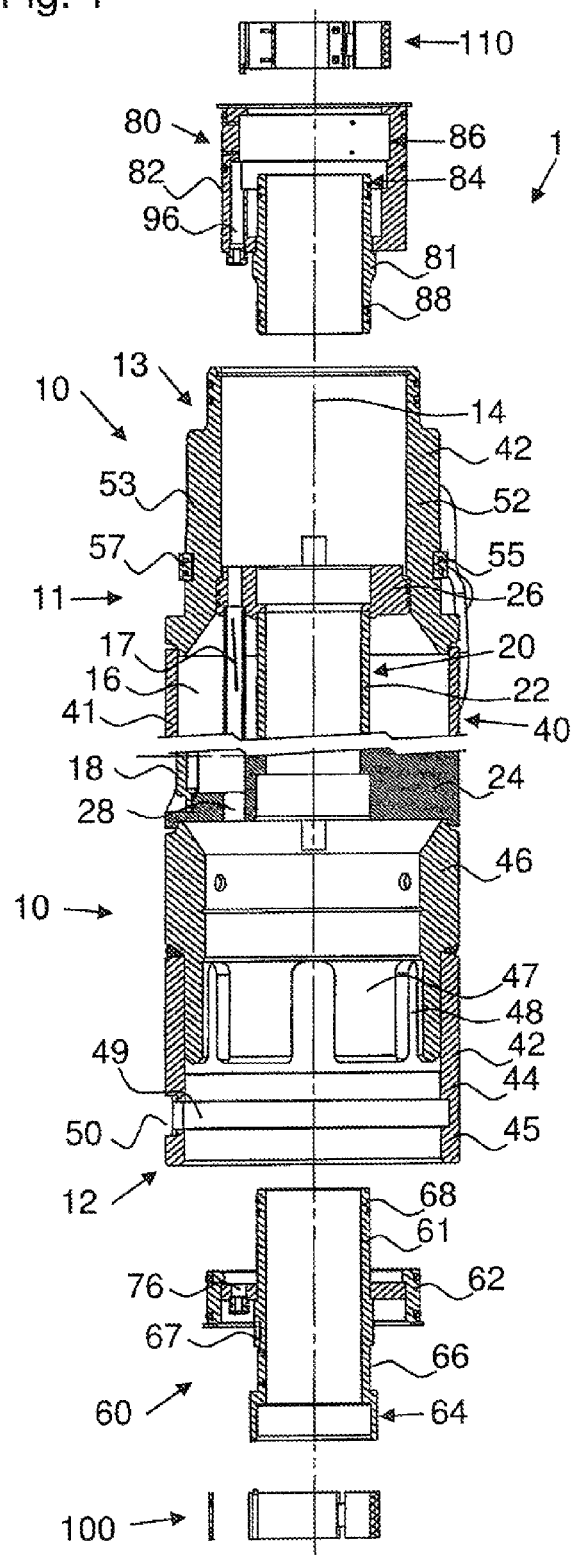

| | | | | |
|---|---|---|---|---|
| 7,823,639 | B2 * | 11/2010 | Braden | 166/242.6 |
| 7,886,832 | B2 * | 2/2011 | Partouche | 166/380 |
| 8,164,980 | B2 * | 4/2012 | Sullivan et al. | 367/82 |
| 8,198,898 | B2 * | 6/2012 | Hall et al. | 324/338 |
| 8,284,075 | B2 * | 10/2012 | Fincher et al. | 340/854.4 |
| 8,519,865 | B2 * | 8/2013 | Hall et al. | 340/854.8 |
| 8,662,188 | B2 * | 3/2014 | Chaize et al. | 166/380 |
| 2002/0193004 | A1 | 12/2002 | Boyle et al. | |
| 2007/0102197 | A1 | 5/2007 | Rotthaeuser | |
| 2010/0116550 | A1 | 5/2010 | Hutin et al. | |
| 2010/0175890 | A1 | 7/2010 | Bray et al. | |
| 2012/0222858 | A1 * | 9/2012 | Stimpfle-Ziegler | 166/242.6 |
| 2013/0014992 | A1 * | 1/2013 | Sharp et al. | 175/45 |

FOREIGN PATENT DOCUMENTS

| | | | |
|---|---|---|---|
| JP | H01-97792 | A | 4/1989 |
| JP | H05-33576 | A | 2/1993 |
| JP | 2007-518906 | A | 7/2007 |
| JP | 2009-503306 | A | 1/2009 |
| WO | 2010101549 | A1 | 9/2010 |

OTHER PUBLICATIONS

English translation of the Notice of Allowance issued by the Japanese Patent Office on Feb. 19, 2013, which corresponds to Japanese Patent Application 2012-041106 and is related to U.S. Appl. No. 13/412,424.

* cited by examiner

DRILL ROD

The invention relates to a drill rod having at least two rod elements, which are connected to each other in a rotationally fixed and detachable manner, in accordance with the preamble of claim 1.

The rod elements of the drill rod each have an inner pipe and an outer pipe, between which a ring-shaped receiving space is formed. Furthermore, the rod elements each have an energy and/or data line, which extends along a longitudinal axis of the drill rod. The energy and/or data lines of the rod elements are each connected to an induction coil, wherein the induction coils can be coupled to each other inductively for energy and/or data transmission along the drill rod.

The drill rod concerned can, in particular, be a drill rod of an auger for producing bores in the ground. Such bores are made for example for the purpose of foundation ground improvement or for the production of bored piles or cut-off walls.

Due to the fact that the bores to be produced in the ground frequently have a considerable depth or length the drill rods are usually constructed of multiple parts consisting of a plurality of rod elements. The individual rod elements each have connecting means at their ends for the mechanical connection to an adjacent rod element. For instance a first end of a rod element has a male junction area and a second end lying opposite the first end has a female junction area. In this way, a plurality of rod elements that are of substantially identical design can be connected to a drill rod or drill string. In this connection it is important that not only the outer pipes but also the inner pipes have to be connected to each other.

During the production of bores it is often desirable to transmit data of a position inside the borehole, in particular the tip of the borehole, to an operator of the drilling device. Such data can include, for example, pressure or temperature values, inclination angles or salt contents in the borehole. Moreover, in certain drilling methods it may be advantageous to transmit data, such as operating parameters, to the tip of the borehole or to a drilling head. For these purposes it is known to provide energy and/or data lines in a drill rod, via which information can be transmitted along the drill rod.

An example of an auger having two rod segments that each comprise an outer pipe and an inner pipe is described in DE 299 14 494 U1. Between inner pipe and outer pipe a cable is guided in each rod segment. The cables are coupled to each other by means of plug connections.

To connect lines inside a drill string it is furthermore known to provide induction coils at the axial ends of the rod elements, via which the lines can be coupled inductively.

An example of an inductive coupling, although not in the case of a double pipe, is disclosed in US 2002/0193004 A1. The induction coils are arranged directly on the axial connecting areas of the rod elements.

The invention is based on the object to provide a compact and easy-to-retrofit connection for energy and/or data lines in a drill rod consisting of rod elements with inner and outer pipe.

The object is solved in accordance with the invention by a drill rod having the features of claim 1. Preferred embodiments are stated in the dependent claims as well as in the description and Figures.

The drill rod according to the invention is characterized in that a first rod element has an inner induction coil located at an outer circumference of its inner pipe and a second rod element has an outer induction coil located at an inner circumference of its outer pipe and in that the induction coils are constructed segmentally of several ring segment parts and overlap at least in some areas in the radial direction.

Basically, the drill rod can be employed in any drilling method and with any desired drilling device. The inner pipe of the drill rod, which can also be referred to as a double rod, can be employed e.g. as a so-called flush pipe. In many cases, bores in the ground are carried out in a flushing manner, i.e. a flushing liquid is introduced via the drill rod into the ground which emerges from the drill rod at the borehole bottom and flushes back the removed drill spoil. Hence, in this case the inner pipe serves for the introduction of the flushing liquid into the borehole.

Another function of the inner pipe can also reside in the introduction of a hardening suspension. For the production of bored piles e.g. concrete can be introduced via the inner pipe into the borehole on completion of drilling during the extraction of the drill rod. Therefore, the inner pipe can also be referred to as a concreting pipe.

A first fundamental idea of the invention resides in the fact that the induction coils, which are in mutual operative connection, are not provided on one and the same pipe, i.e. not on the inner pipe or on the outer pipe in each case, but that a first induction coil is arranged on the inner pipe and a second induction coil is arranged on the outer pipe of the respective rod element. Hence, according to the invention the induction coils are located between the inner rod and the outer rod. As a result, the front faces of the rod elements or the connecting areas of the rod elements can be kept free so that customary connector systems can still be used. The arrangement of the induction coils according to the invention therefore offers the possibility to easily retrofit existing drill rods or rod elements, in which case connector systems already present, especially those of the outer pipes, can continue to be used.

Another fundamental idea of the invention can be seen in the fact that the induction coils, which are in mutual operative connection, are arranged such that in the case of mutually connected rod elements the coils overlap in the radial direction, i.e. they are arranged radially with respect to each other at least in some areas. The radial arrangement of the induction coils with respect to each other also adds to the improved possibility to retrofit since the axial front faces of the rod elements can remain free.

For easy installation of the induction coils these are constructed of several segments in accordance with the invention. This is to be understood, in particular, in that the induction coils are not composed of one part but of several parts. The individual parts or segments form ring segments of the ring-shaped coils.

The invention provides the possibility of arranging the induction coils on the transition between two rod elements, though outside the connecting or coupling areas of the rod elements. In this way, the connecting areas are not interfered with by the induction coils. Here, a connecting area is understood, in particular, as that section of the outer pipe and/or inner pipe which serves for a rotationally and axially fixed connection of the respective pipes between each other. A connecting area can comprise for example a thread, one or several grooves, snap-lock or plug connections or other connector systems. According to the invention the induction coils are preferably arranged in an axially and/or radially spaced manner from the connecting areas or connecting surfaces of the rod elements.

To achieve an especially compact arrangement it is preferred that at least one of the induction coils is arranged in a ring-shaped receiving groove. The receiving groove can, in particular, be an outer groove located at the outer circumference of the inner pipe or an inner groove located at the inner circumference of the outer pipe. Accordingly, it is especially preferred that the inner induction coil is arranged in an outer groove of the inner pipe of the first rod element and/or the outer induction coil is arranged in an inner groove of the outer pipe of the second rod element. Because of the split induction coils constructed of several ring segment parts these are particularly easy to insert into the respective grooves.

The handling of the induction coils, especially the insertion into the respective grooves, can be facilitated in that at least two ring segment parts are detachably connected to each other. Here, a detachable connection is understood, in particular, as such a connection that can be detached with tools or manually and that can be restored again, in particular through reversal of the detachment process. In a detachable connection the connected elements do not suffer substantial damage when being detached from each other. A detachable connection can be a screw, plug or snap-lock connection for example.

Another preferred embodiment with regard to the induction coils is provided in that at least two ring segment parts are movable with respect to each other. In this way, the shape of the induction coil can be modified so that the insertion of the coil into a groove is facilitated further. It is especially preferred that at least two ring segment parts are rotatably connected to each other. As a result of the rotary connection, whose axis of rotation can run in particular parallel to a longitudinal axis of the induction coil, a further facilitation of inserting the coil into the respective rod element is achieved in an advantageous manner. Means can be provided for locking the rotary connection in order to safely hold an inserted induction coil.

In a further preferred embodiment of the invention provision is made for the inner pipe of the first rod element to have a plug- or sleeve-shaped junction area for connection to a further inner pipe and for the inner induction coil to be arranged in an axially spaced manner from the plug- or sleeve-shaped junction area. Consequently, the junction area is available for joining the inner pipe of an adjacent rod element without interference from the induction coil. In particular, the inner pipe can have a receiving groove, which is provided in an axially spaced manner from the junction area and in which the induction coil is arranged.

In an especially preferred embodiment of the invention provision is made for the outer induction coil to be arranged inside a plug-shaped junction part of the outer pipe of the second rod element. Hence, in the case of joined rod elements the outer induction coil is preferably positioned such that it is located radially inside a plug-shaped junction part of the outer pipe of the second rod element.

During drilling considerable torques are normally transmitted via the outer pipe and the pipe connections between two adjacent outer pipes. Due to the fact that the outer induction coil is arranged radially inside a junction part of the outer pipe the said junction part is fully available for providing mechanical stability. In particular, this can also be ascribed to the fact that the connecting area of a plug-shaped junction part is usually located at the outer circumference of the junction part and can thus be kept completely free from the induction coil. Moreover, the arrangement of the coil inside the junction part makes it possible that plug-shaped junction parts already present can still be used largely unchanged in the case of retrofitting with induction coils. Hence, a rod element can be retrofitted simply by arranging an induction coil on the plug-shaped junction part of its outer pipe on the inner circumference thereof.

A simple possibility of retrofitting and replacement in the case of a defect can be achieved in that at least one of the rod elements comprises an adapter or mounting sleeve, on which the inner induction coil and/or the outer induction coil is mounted. Thus, the mounting sleeve forms at least partly a section of the inner pipe of the first rod element and/or a section of the outer pipe of the second rod element.

By preference, the mounting sleeve is a part separate from the rod element, which is connected to the rod element in particular in a fixed manner, preferably in an axially and rotationally fixed manner. Hence, the inserted mounting sleeve is preferably not movable relative to the rod element. In particular, provision can be made for the mounting sleeve to be welded, pressed onto or screwed to a basic pipe body of the inner pipe and/or the outer pipe. For replacement of the mounting sleeve it is preferably inserted in a detachable manner into the rod element. It is especially preferred if the mounting sleeve can be introduced in the longitudinal direction into the rod element.

By preference, the first rod element has a first mounting sleeve and the second rod element has a second mounting sleeve. In a preferred embodiment the mounting sleeves can be coupled to each other mechanically.

Especially with regard to the outer induction coil the mounting sleeve is preferably designed for insertion into a basic pipe body or a junction area of the outer pipe. Therefore, the mounting sleeve for the outer induction coil can basically be inserted into the outer pipe without any specific adaptation of the said outer pipe that transmits the torques and axial forces.

Especially with regard to the inner induction coil it can be advantageous if the mounting sleeve is arranged on the outer circumference of a basic pipe body of the inner pipe. Due to the fact that a smaller amount of force is normally transmitted via the inner pipe than via the outer pipe, it may, however, also be advantageous for an especially compact arrangement if the mounting sleeve for the inner induction coil is arranged in the axial extension of the basic pipe body of the inner pipe.

By preference, the mounting sleeve comprises a receiving area for the inner induction coil and/or the outer induction coil. For this purpose e.g. an inner groove and/or an outer groove can be provided on the mounting sleeve.

It is particularly preferred that the mounting sleeve has a pipe-shaped section which is arranged in the axial extension of a basic pipe body of the inner pipe of the first rod element. It is also possible to provide the mounting sleeve in addition to an existing axial end area of the inner pipe. Hence, an existing rod element can be retrofitted in an especially easy way in that an axial end of its inner pipe is replaced or supplemented by the mounting sleeve with inner induction coil.

Another preferred embodiment resides in the fact that the mounting sleeve is inserted into a junction part of the outer pipe. This provides a simple possibility to retrofit a rod element, in which case the junction part of its outer pipe, via which considerable forces are possibly transmitted, can remain largely unchanged. In particular, it is preferred in accordance with the invention that the mounting sleeve is arranged and/or fixed inside a plug-shaped junction part of the outer pipe. In this way, an outer induction coil can be attached easily to the outer pipe.

For guidance of the energy and/or data line the mounting sleeve preferably has a cable channel. The cable channel can comprise an opening for the energy and/or data line, via which the line of the inner and/or outer induction coil is led into the ring space between the inner pipe and outer pipe. By preference, the cable channel extends in the longitudinal direction of the rod element and the drill rod, respectively.

Ease of maintenance of the drill rod is achieved in that the outer pipe of the first rod element and/or the second rod element has a cap that can be opened for access to the energy and/or data line.

Figure 2:
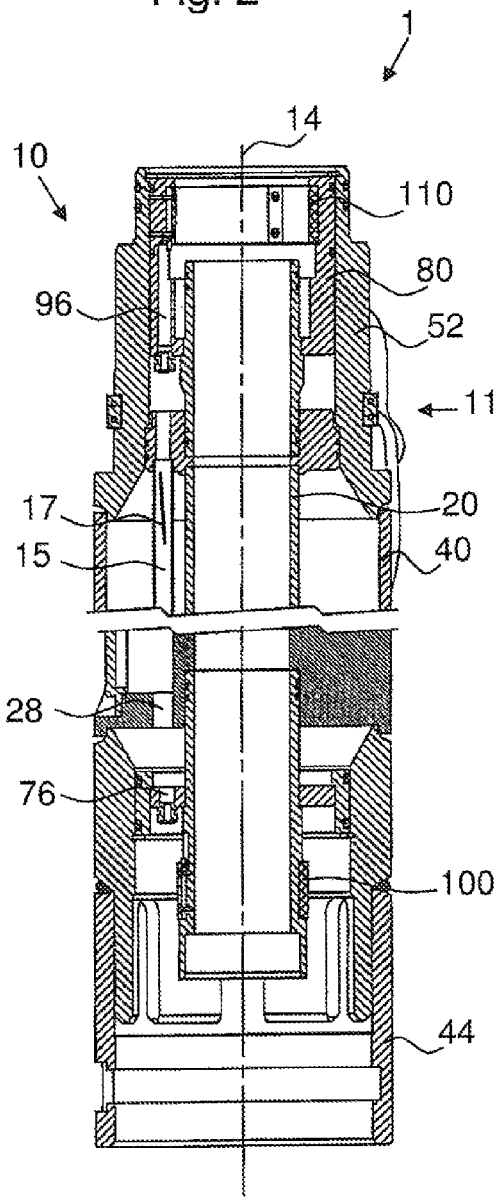
Figure 3:
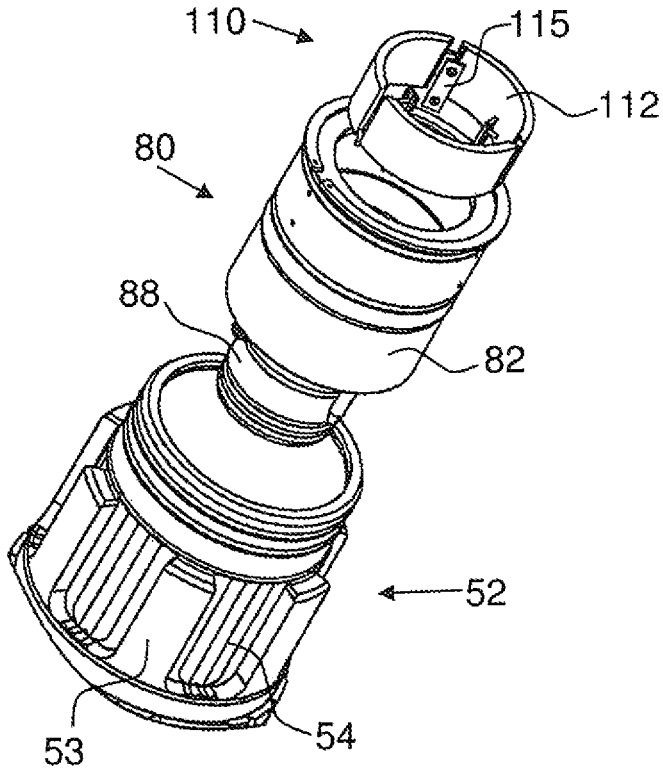
Figure 4:
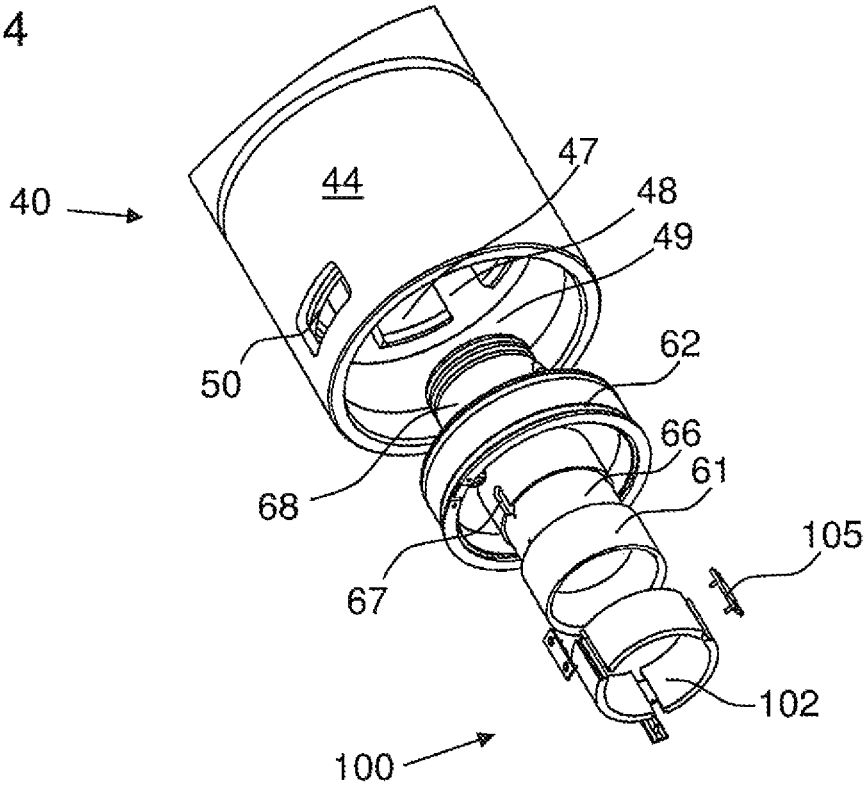
Figure 5:
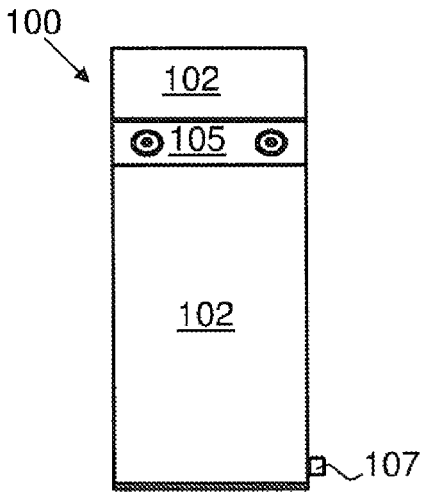
Figure 6:
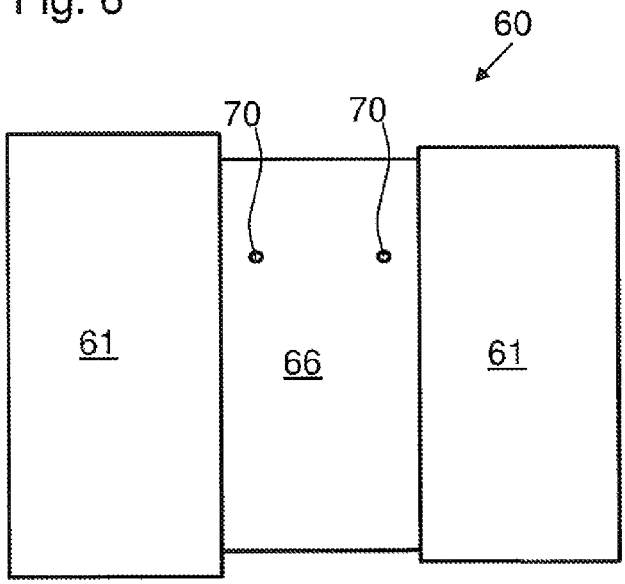
Figure 7:
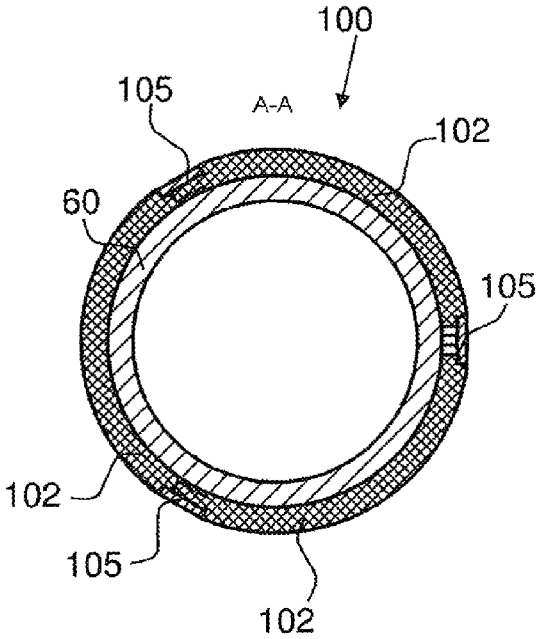
Figure 8:
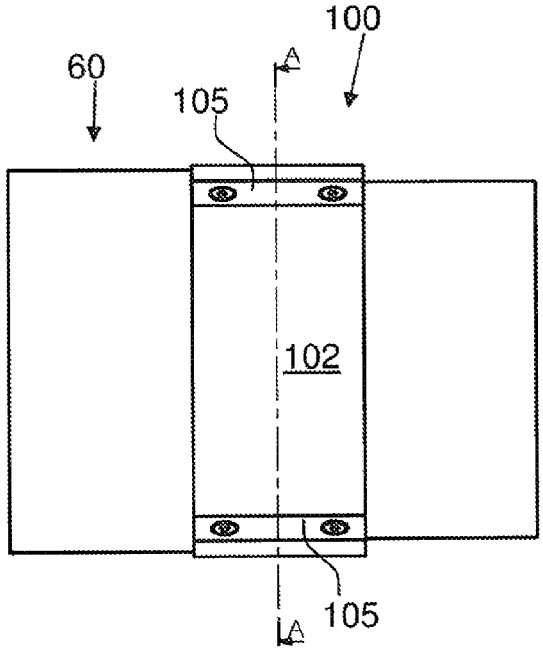
Figure 9:
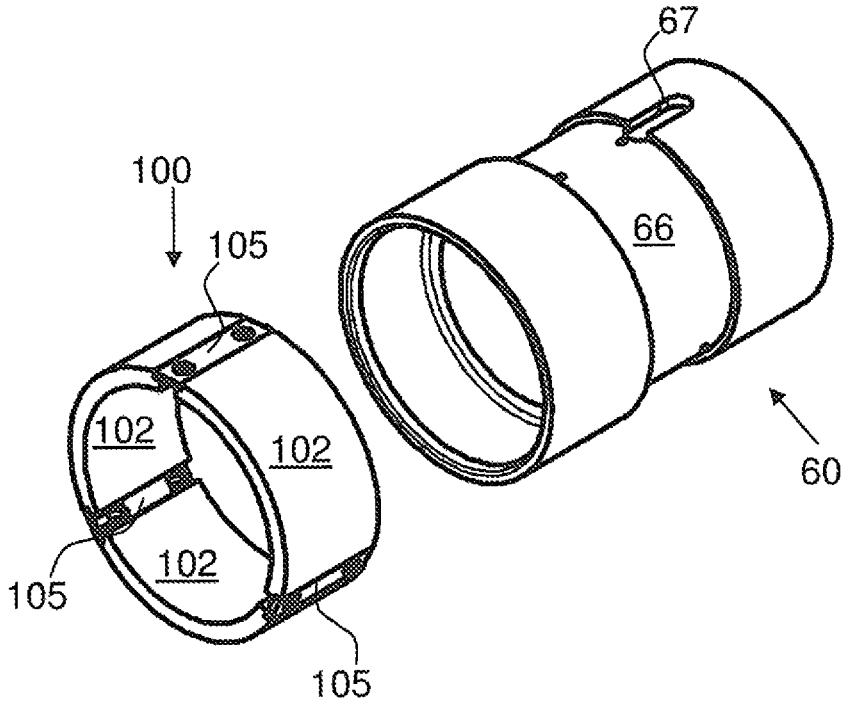
Figure 10:
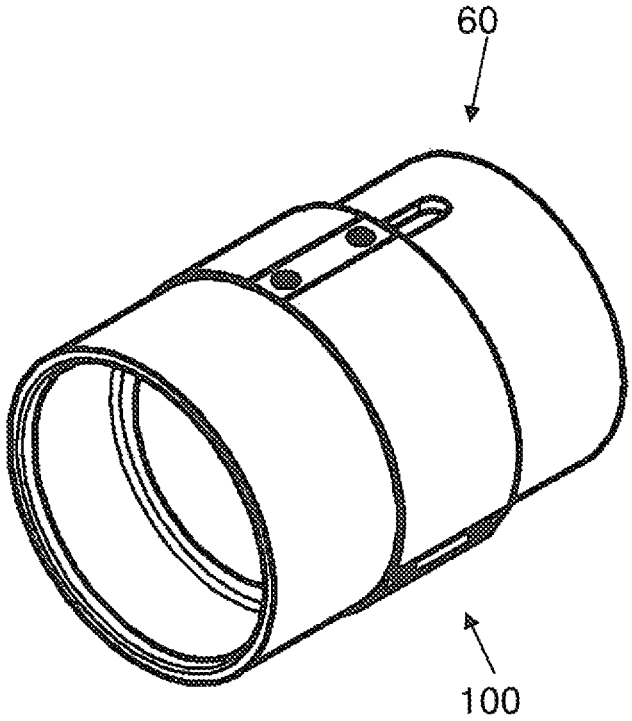
Figure 11:
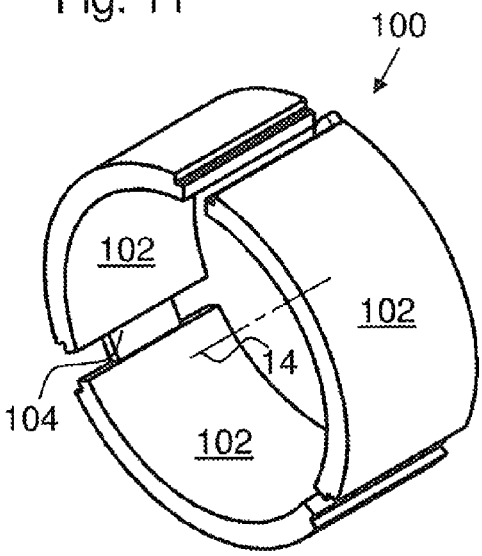
Figure 12:
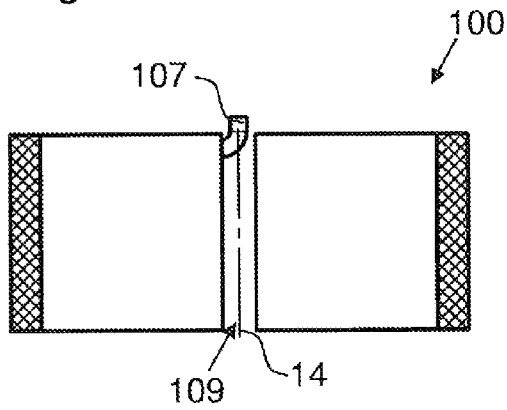
Figure 13:
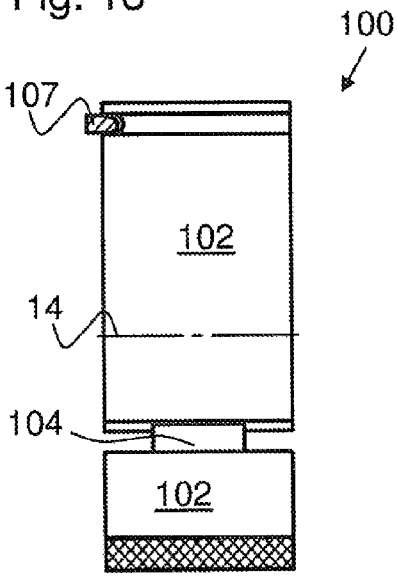
Figure 14:
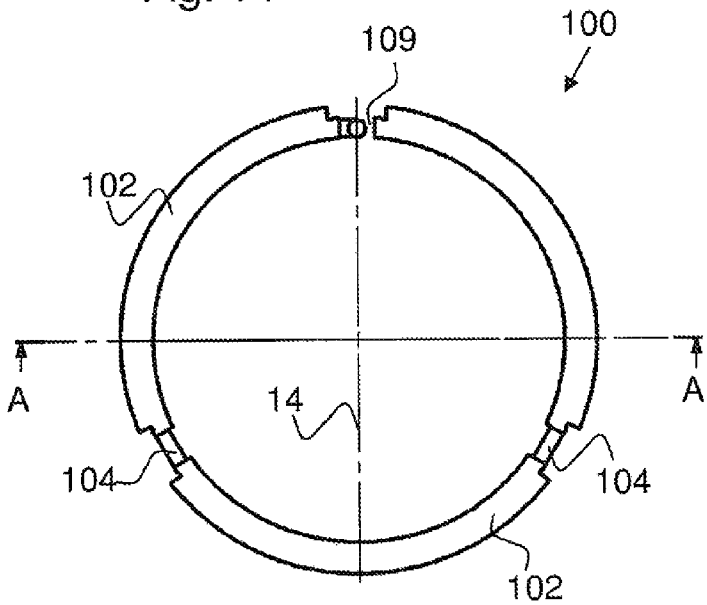
Figure 15:
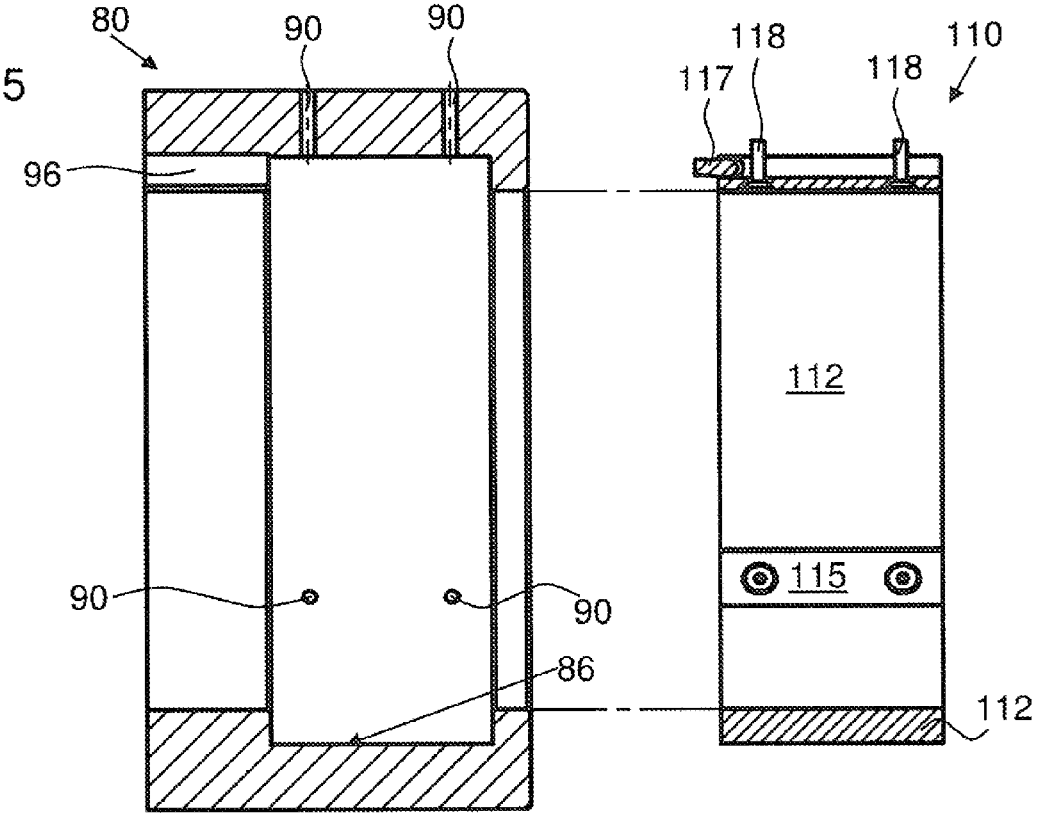
Figure 16:
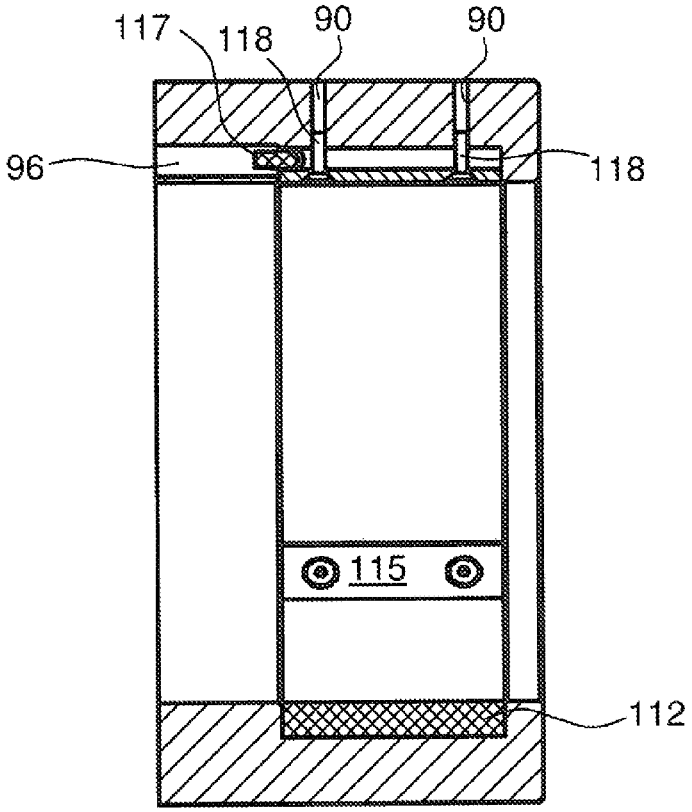
Figure 17:
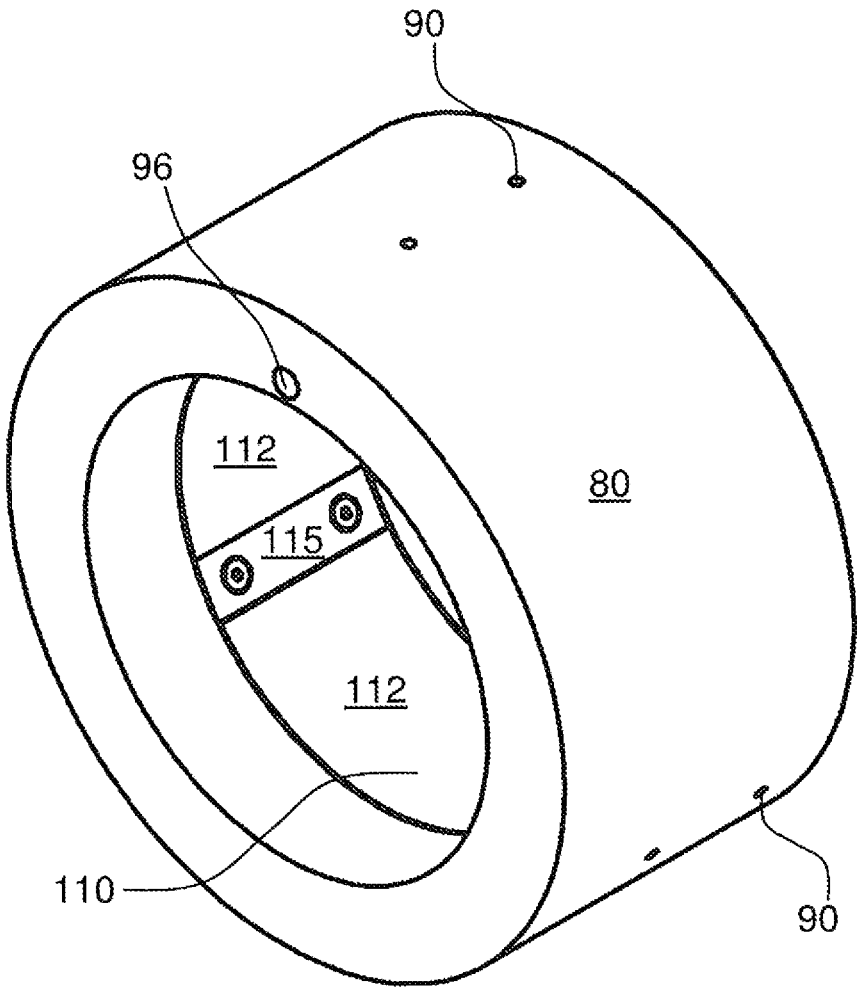
Figure 18:
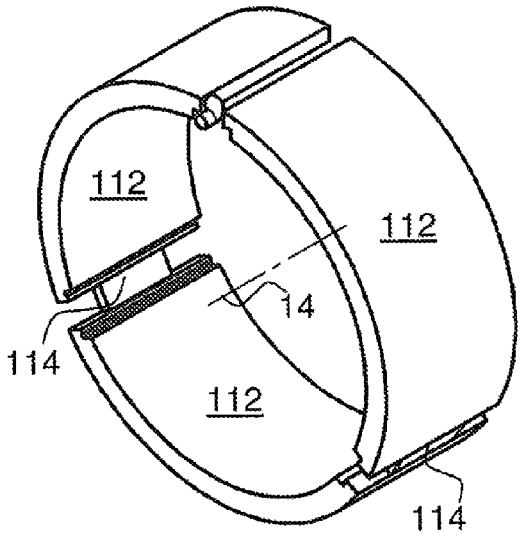
Figure 19:
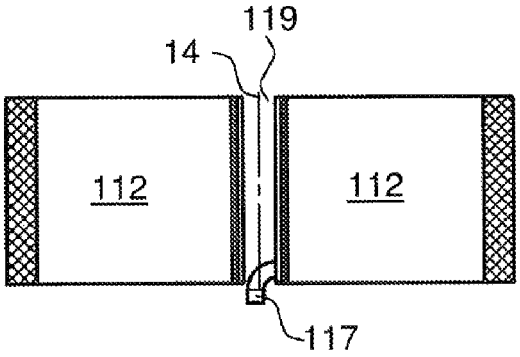
Figure 20:
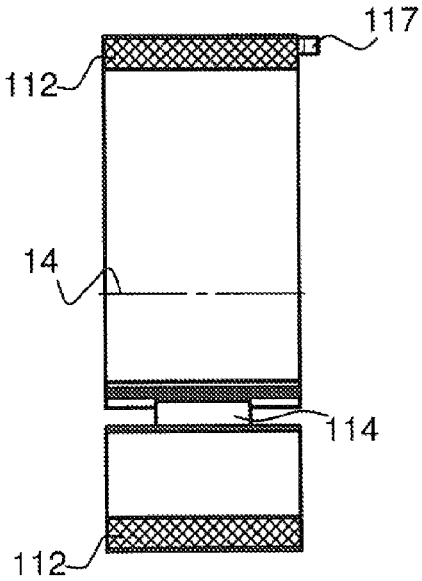
Figure 21:
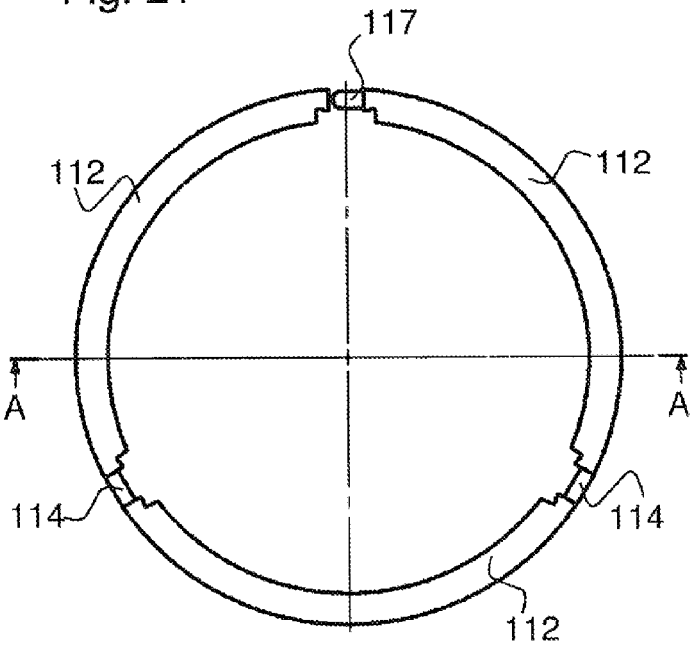
Figure 22:
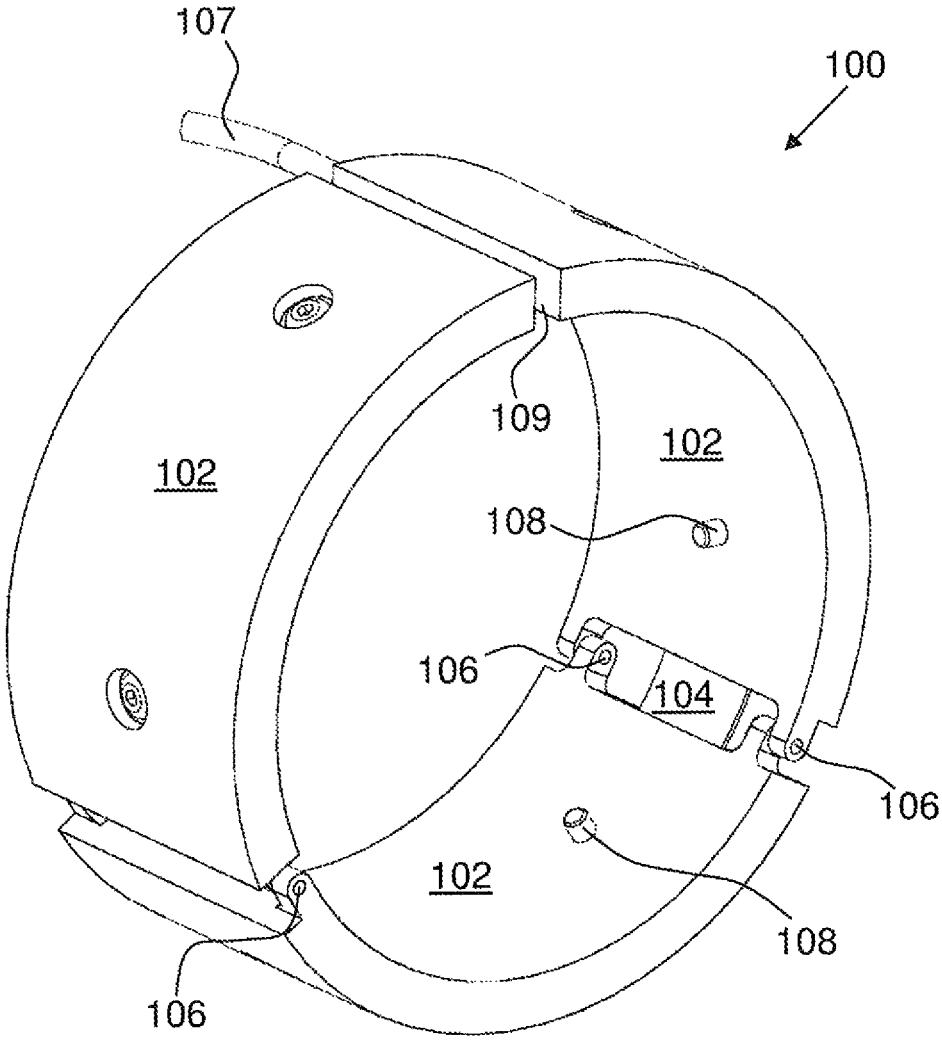

In the following the invention will be explained further by way of preferred embodiments illustrated in the accompanying schematic drawings, wherein show:

FIG. 1 a cross-sectional view of a rod element of a drill rod with separate mounting sleeves and induction coils;

FIG. 2 a cross-sectional view of the rod element of FIG. 1 with inserted mounting sleeves and induction coils;

FIG. 3 a perspective view of an upper section of the rod element of FIG. 1;

FIG. 4 a perspective view of a lower section of the rod element of FIG. 1;

FIG. 5 a side view of an inner induction coil;

FIG. 6 a side view of a first mounting sleeve;

FIG. 7 a cross-sectional view of the mounting sleeve of FIG. 6 along the line A-A of FIG. 8;

FIG. 8 a side view of the mounting sleeve of FIG. 6 with inserted inner induction coil;

FIG. 9 a perspective view of the mounting sleeve of FIG. 6 with separate inner induction coil;

FIG. 10 a perspective view of the mounting sleeve of FIG. 6 with inserted inner induction coil;

FIG. 11 a perspective view of an inner induction coil;

FIG. 12 a cross-sectional view of the inner induction coil of FIG. 11 along the line A-A of FIG. 14;

FIG. 13 a cross-sectional view of the inner induction coil of FIG. 11 in the vertical direction;

FIG. 14 a view from the front of the inner induction coil of FIG. 11;

FIG. 15 a sectional view of a second mounting sleeve with separate outer induction coil;

FIG. 16 a sectional view of the second mounting sleeve of FIG. 15 with inserted outer induction coil;

FIG. 17 a perspective view of the second mounting sleeve of FIG. 15 with inserted induction coil;

FIG. 18 a perspective view of an outer induction coil;

FIG. 19 a cross-sectional view of the outer induction coil of FIG. 18 along the line A-A of FIG. 21;

FIG. 20 a cross-sectional view of the outer induction coil of FIG. 18 in the vertical direction;

FIG. 21 a view from the front of the outer induction coil of FIG. 18;

FIG. 22 a perspective view of an inner induction coil and

Figure 23:
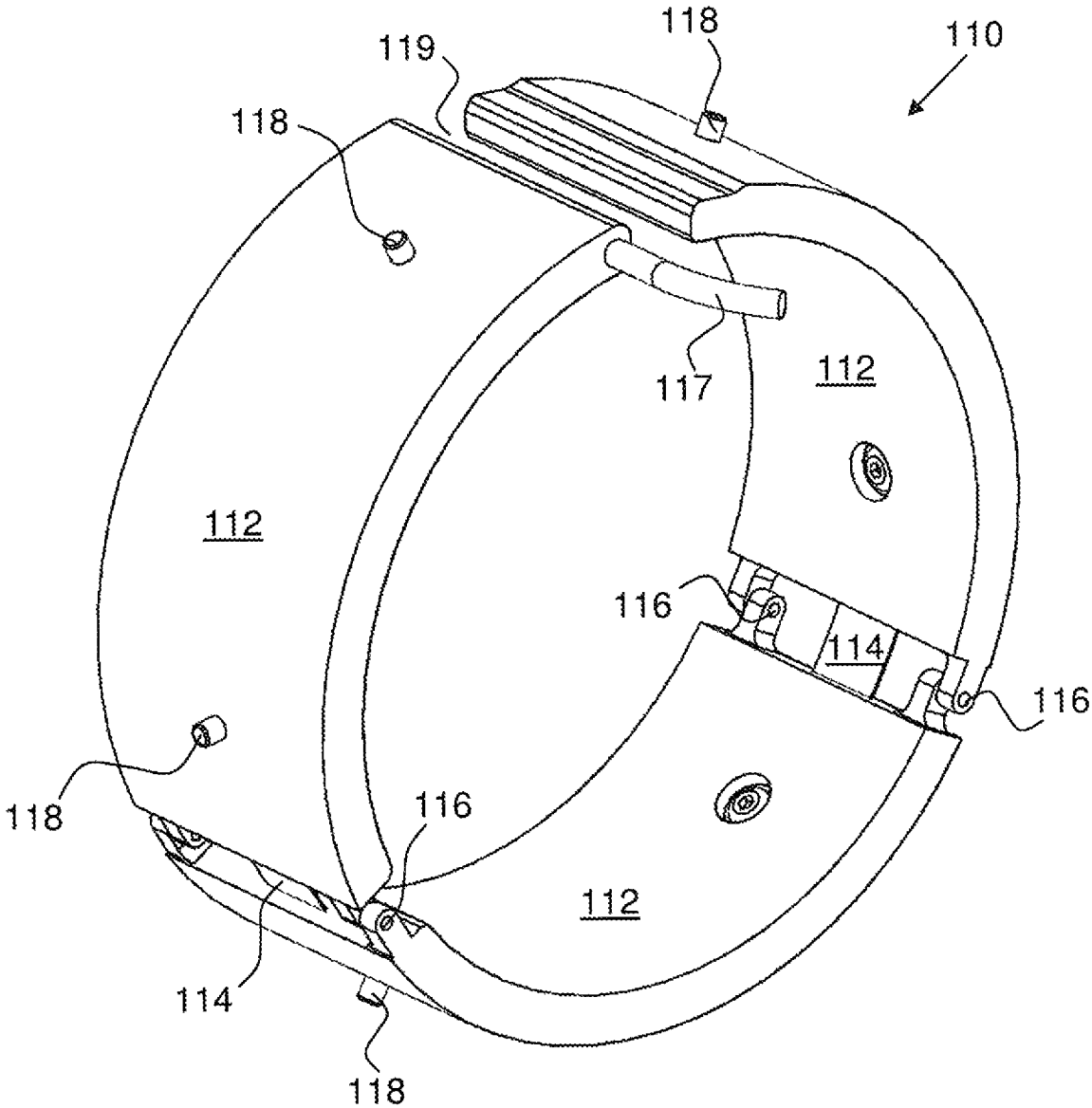

FIG. 23 a perspective view of an outer induction coil.

In all Figures identical or corresponding components are provided with the same reference signs.

FIGS. 1 and 2 show an embodiment of a rod element 10 of a drill rod 1 according to the invention, which has a first junction area at a first axial end 12 and a second junction area at a second axial end 13. On the two junction areas a further rod element can be joined in each case. Consequently, by connecting several rod elements to each other, which can substantially have the same construction, a drill rod of basically any length can be formed. A longitudinal axis of the drill rod is designated with reference sign 14.

FIG. 3 shows a detail of the upper axial end of the rod element 10 in perspective view. In FIG. 4 the lower axial end of the rod element 10 is depicted in perspective view.

In the following an embodiment of a rod element 10, which can be a component of the drill rod in accordance with the invention, will be described with reference to FIGS. 1 to 4.

The rod element 10 has an inner pipe 20 and an outer pipe 40 arranged coaxially thereto. Inner pipe 20 and outer pipe 40 are connected to each other in a rotationally fixed manner, i.e. essentially no relative rotational movement between inner pipe 20 and outer pipe 40 is possible.

Between inner pipe 20 and outer pipe 40 a ring-shaped receiving space 16 is formed, in which at least one cable 17 is arranged that is depicted schematically only in FIGS. 1 and 2. The ring space between inner pipe 20 and outer pipe 40 or a section thereof can therefore also be referred to as a cable reservoir. The outer pipe 40 has a cap 18 for opening the cable reservoir or alternatively the receiving space 16. In this manner, easy access to the cable reservoir or the receiving space 16 is made available. In the receiving space 16 a channel 15 is formed at least in sections for the cable or, where applicable, the cables 17.

The inner pipe 20 comprises a basic pipe body 22 that extends across a considerable part of the length of the rod element 10. The basic pipe body 22 has a pipe-shaped construction with a substantially constant wall thickness. At a lower end of the basic pipe body 22 shown in FIGS. 1 and 2 a first intermediate piece 24 is provided which forms part of the inner pipe 20. As can be taken from FIGS. 1 and 2, the first intermediate piece equally constitutes a part of the outer pipe 40. In the first intermediate piece 24 an axial channel 28 is provided for the passage of cable 17.

At a second, upper end of the inner pipe 20 a second intermediate piece 26 is provided. The second intermediate piece 26 is arranged inside the outer pipe 40 and firmly connected thereto. By preference, the intermediate piece 26 is press-fitted into and/or welded to the outer pipe 40.

First intermediate piece 24 and second intermediate piece 26 serve for the coupling of mounting sleeves 60, 80. The intermediate pieces 24, 26 can therefore also be referred to as coupling pieces.

The outer pipe 40 comprises a pipe-shaped basic pipe body 41 which extends along a considerable part of the length of the outer pipe 40. At both axial ends of the outer pipe 40 a junction part 42 is provided in each case for connection to an adjacent outer pipe. The end of the outer pipe 40 shown at the bottom in FIGS. 1 and 2 comprises a receiving socket 44 which can also be referred to as a female junction part. In the depicted embodiment the receiving socket 44 comprises a first socket part 45 and a second socket part 46 which are firmly connected, in particular welded to each other. In the receiving socket 44 axial ribs 47 and axial grooves 48 are provided in order to bring about a rotationally fixed connection to an adjacent outer pipe. In addition, the receiving socket 44 comprises a circumferential groove 49 for producing an axially fixed connection to an adjacent outer pipe. The circumferential groove 49 is provided as an inner groove in the receiving socket 44. In one area of the circumferential groove 49 an access opening 50 is provided, via which a securing element, in particular a link chain 57 for the axial securing to an adjacent outer pipe can be inserted.

At an end shown at the top in FIGS. 1 and 2 the outer pipe 40 has a plug part 52 which can also be referred to as a male junction part. The plug part 52 comprises axial ribs 53 and axial grooves 54 that correspond to the axial ribs 47 and axial grooves 48 of the receiving socket 44. Furthermore, the plug part 52 has a circumferential groove 55 corresponding to the circumferential groove 49, which is designed as an outer groove on the plug part 52. For the axial securing of a plug part 52 with respect to a receiving socket 44 a link chain 57 is inserted into the circumferential grooves 49, 55.

Inside the receiving socket 44 a first mounting sleeve 60 is provided to receive a first induction coil which can also be referred to as an inner induction coil 100. The first mounting sleeve 60 comprises a pipe-shaped section 61 that forms part of the inner pipe 20. Furthermore, the first mounting sleeve 60 comprises a support ring 62 for support on the outer pipe 40. At an axial end area of the pipe-shaped section 61 a junction area 64 for coupling with the inner pipe of an adjacent rod element is provided. In the illustrated embodiment the junction area 64 is designed as a female junction area.

To receive the inner induction coil 100 a radial receiving groove 66 is designed on the first mounting sleeve 60, in particular on its pipe-shaped section 61. The receiving groove 66 is located at an outer circumference of the pipe-shaped section 61 and can therefore be referred to as an outer groove.

Adjacent to the receiving groove 66 an engaging groove or opening 67 is designed for easy removal of the inner induction coil 100, as can also be taken from FIGS. 4, 9 and 10 in particular.

Between the support ring 62 and the pipe-shaped section 61 a cable channel 76 for the passage of a cable is designed.

At an end lying opposite junction area 64 the first mounting sleeve 60 comprises a connecting area 68 for connection to the basic pipe body 22 of the inner pipe 20 or the first intermediate piece 24 or generally a coupling piece of the inner pipe 20.

At its axial end 13 depicted at the top in FIGS. 1 and 2 the rod element 10 has a second mounting sleeve 80 which is designed to receive an outer induction coil 110. The second mounting sleeve 80 comprises a pipe-shaped section 81 that forms part of the inner pipe 20. The pipe-shaped section 81 has a junction area 84 which can also be referred to as a male junction area. The junction area 84 corresponds in design to the junction area 64 of the first mounting sleeve 60. At its end lying opposite junction area 84 a connecting area 88 for connection of the second mounting sleeve 80 to the basic pipe body 22 of the inner pipe 20 or the second intermediate piece 26 or generally a coupling piece of the inner pipe 20 is provided.

Furthermore, the second mounting sleeve 80 comprises a sleeve body 82 which is provided for resting against an inner circumference of a part of the outer pipe 40, more particularly against its junction part 42 and/or its basic pipe body 41. At its inner circumference the sleeve body 82 has a radial receiving groove 86 for the outer induction coil 110. The receiving groove 86 can also be referred to as an inner groove and extends annularly in the circumferential direction along an inner circumferential surface of the sleeve body 82. Between pipe-shaped section 81 and sleeve body 82 a cable channel 96 for the passage of a cable is provided.

The cap 18 for the cable reservoir is preferably arranged at an axial end of the basic pipe body 41 of the outer pipe 40, in particular adjacent to the first and/or second intermediate piece 24, 26.

As already set out, a drill rod according to the invention can be produced by arranging several rod elements 10, 11 in a row. Hence, in a drill rod according to the invention in particular a first rod element 10 can be provided which has the features described in conjunction with the lower axial end of the rod element shown in FIGS. 1 and 2. Furthermore, a second rod element 11 can be provided which has the features described in conjunction with the upper axial end of the rod element. Thus, FIGS. 1 and 2 can also be understood in such a way that in the respective lower area a first rod element 10 is shown and in the respective upper area a second rod element 11 is shown. The rod elements 10, 11 can be coupled with each other. The induction coils and mounting sleeves described in conjunction with FIGS. 5 to 23 can optionally refer to a first rod element 10 or a second rod element 11.

FIGS. 5 to 10 show further details of an inner induction coil 100 and a first mounting sleeve 60 or a part thereof. The first mounting sleeve 60 serves, in particular, for receiving an inner induction coil 100. As can be taken from FIG. 7 in particular, the induction coil 100 has several, in the present case three ring segment parts 102. Between two ring segment parts 102 the induction coil 100 has an opening area 109 or slot, where the coil can be pulled apart for insertion into the provided receiving groove 66. The induction coil 100 thus split can be inserted easily into the radial receiving groove 66.

For a positionally secure fixing of the induction coil 100, fixing means 70 are provided on the receiving groove 66, which are designed here by way of example as recesses in the groove surface. Accordingly, the induction coil 100 has corresponding fixing means 108 which are designed here as pins on the inner surface of the coil.

FIGS. 11 to 14 show by way of an exemplary embodiment further details of an inner induction coil 100. The individual ring segment parts 102 are connected to each other via plug connectors 104. The plug connectors 104 can also form part of a coil body or the windings of the coil body. Between two ring segment parts 102 a cover 105 is provided in each case which covers the plug connectors 104.

Further details of an inner induction coil 100 are illustrated by way of the embodiment in FIG. 22. At least some of the ring segment parts 102 are rotatably connected to each other via rotary joints 106. The axes of rotation of the rotary joints 106 run along a longitudinal axis of the induction coil 100. To connect the coil body to the energy and/or data line an electrical junction means or junction line 107 is provided on one of the ring segment parts 102. The said junction line is preferably located in or close to the opening area 109 of the inner induction coil 100. The junction line 107 is preferably arranged at a front face of the induction coil 100.

FIGS. 15 to 17 show a second mounting sleeve 80 and an outer induction coil 110. The second mounting sleeve 80 serves, in particular, for receiving an outer induction coil 110. The outer induction coil 110 is substantially designed according to the inner induction coil 100 and has a larger diameter compared thereto so that the outer induction coil 110 can be arranged around the inner induction coil 100.

FIGS. 18 to 21 show a further exemplary embodiment of an outer induction coil 110. The outer induction coil 110 substantially corresponds to the inner induction coil 100 and is equally composed of several ring segment parts 112 which are connected to each other via plug connectors 114. Between two ring segment parts 112 an opening area 119 or slot is designed, where the coil can be pulled together for insertion into the provided receiving groove 86. The induction coil 110 thus split can be inserted easily into the radial receiving groove 86.

Further details of an outer induction coil 110 are illustrated in FIG. 23. In line with the inner induction coil 100 some of the ring segment parts 112 are rotatably connected to each other via rotary joints 116, in which case the axes of rotation of the rotary joints 116 run along a longitudinal axis of the induction coil 110. Between two ring segment parts 112 a cover 115 is provided in each case which covers the plug connectors 114. To connect the coil body to the energy and/or data line an electrical junction means or junction line 117 is provided that is preferably located in or close to the opening area 119. The junction line 117 is preferably arranged at a front face of the induction coil 110.

For a positionally or rotationally secure fixing of the induction coil 110, fixing means 90 are provided on the receiving groove 86, which are designed here by way of example as recesses in the groove surface. Accordingly, the induction coil 110 has corresponding fixing means 118 which are designed here as pins on the outer surface of the coil. The fixing means

118 of the induction coil 110 can be brought into engagement with the fixing means 90 of the second mounting sleeve 80.

Both the inner induction coil and the outer induction coil have a coil body with at least one winding. The one or perhaps several windings of the coil body can basically be arranged in any chosen way. For example the induction coil 100, 110 can have one or several windings in the circumferential direction. However, the induction coil 100, 110 can also be designed as a so-called toroid coil, in which one or several windings are wound around the ring that can be referred to as a toroidal core.

The invention claimed is:

1. Drill rod having at least two rod elements, which are connected to each other in a rotationally fixed and detachable manner, wherein the rod elements each have an inner pipe and an outer pipe, between which a ring-shaped receiving space is formed, the rod elements each have an energy and/or data line, which extends along a longitudinal axis of the drill rod, and the energy and/or data lines of the rod elements are each connected to an induction coil, wherein the induction coils can be coupled to each other inductively for energy and/or data transmission along the drill rod, wherein a first rod element has an inner induction coil located at an outer circumference of its inner pipe and a second rod element has an outer induction coil located at an inner circumference of its outer pipe and in that the induction coils are constructed segmentally of several ring segment parts and overlap at least in some areas in the radial direction.

2. Drill rod according to claim 1, wherein at least one of the induction coils is arranged in a ring-shaped receiving groove.

3. Drill rod according to claim 1, wherein at least two ring segment parts are detachably connected to each other.

4. Drill rod according to claim 1, wherein at least two ring segment parts are rotatably connected to each other.

5. Drill rod according to claim 1, wherein the inner pipe of the first rod element has a plug- or sleeve-shaped junction area for connection to a further inner pipe and in that the inner induction coil is arranged in an axially spaced manner from the plug- or sleeve-shaped junction area.

6. Drill rod according to claim 1, wherein the outer induction coil is arranged inside a plug-shaped junction part of the outer pipe of the second rod element.

7. Drill rod according to claim 1, wherein at least one of the rod elements comprises a mounting sleeve, on which the inner induction coil and/or the outer induction coil is mounted.

8. Drill rod according to claim 7, wherein the mounting sleeve has a pipe-shaped section which is arranged in the axial extension of a basic pipe body of the inner pipe of the first rod element.

9. Drill rod according to claim 7, wherein the mounting sleeve is inserted into a junction part of the outer pipe.

10. Drill rod according to claim 7, wherein the mounting sleeve has a cable channel for the energy and/or data line.

11. Drill rod according to claim 1, wherein the outer pipe of the first rod element and/or the second rod element has a cap that can be opened for access to the energy and/or data line.

* * * * *